US007610890B2

(12) United States Patent
Lettmann et al.

(10) Patent No.: US 7,610,890 B2
(45) Date of Patent: Nov. 3, 2009

(54) CAMSHAFT WITH CAMS THAT CAN BE ROTATED IN RELATION TO EACH OTHER, ESPECIALLY FOR MOTOR VEHICLES

(75) Inventors: Markus Lettmann, Kieselbronn (DE); Roland Schacherer, Geisingen (DE); Falk Schneider, Korntal-Münchingen (DE)

(73) Assignee: Mahle International GmbH, Stuttgart (DE)

( * ) Notice: Subject to any disclaimer, the term of this patent is extended or adjusted under 35 U.S.C. 154(b) by 157 days.

(21) Appl. No.: 11/883,257

(22) PCT Filed: Jan. 13, 2006

(86) PCT No.: PCT/DE2006/000038

§ 371 (c)(1),
(2), (4) Date: Jul. 27, 2007

(87) PCT Pub. No.: WO2006/081788

PCT Pub. Date: Aug. 10, 2006

(65) Prior Publication Data

US 2008/0257290 A1 Oct. 23, 2008

(30) Foreign Application Priority Data

Feb. 3, 2005 (DE) ..... 10 2005 005 212
Mar. 29, 2005 (DE) ..... 10 2005 014 680

(51) Int. Cl.
*F01L 1/04* (2006.01)

(52) U.S. Cl. ..... 123/90.6; 123/90.44; 29/888.1

(58) Field of Classification Search ..... 123/90.16, 123/90.44, 90.6, 90.27, 90.39, 90.31; 29/888.1
See application file for complete search history.

(56) References Cited

U.S. PATENT DOCUMENTS

| | | | |
|---|---|---|---|
| 4,332,222 | A | 6/1982 | Papez |
| 5,235,939 | A | 8/1993 | Levin et al. |
| 5,664,463 | A | 9/1997 | Amborn et al. |

FOREIGN PATENT DOCUMENTS

| | | | |
|---|---|---|---|
| DE | 36 24 827 | A1 | 2/1988 |
| DE | 39 43 426 | C1 | 4/1991 |
| DE | 44 19 557 | C1 | 10/1995 |
| DE | 195 81 459 | T1 | 2/1997 |
| DE | 695 12 962 | T2 | 5/2000 |

(Continued)

OTHER PUBLICATIONS

International Search Report.

*Primary Examiner*—Ching Chang
(74) *Attorney, Agent, or Firm*—Collard & Roe, P.C.

(57) ABSTRACT

The aim of the invention is to provide a reliable and inexpensive camshaft wherein the inner shaft and the outer shaft can be adjusted in a low-friction manner. For this purpose, a camshaft with cams that can be rotated in relation to each other, wherein at least one first cam (3) is rotatably received on the outer shaft (1), is permanently connected to the inner shaft (2) via at least one radial opening in the outer shaft (1). Means (10) for connecting a camshaft rotational drive are provided at the axial ends of the camshaft. The camshaft is also provided with a rotational drive (9) exerting radial supporting forces onto the camshaft.

28 Claims, 11 Drawing Sheets

FOREIGN PATENT DOCUMENTS

Figure 1:
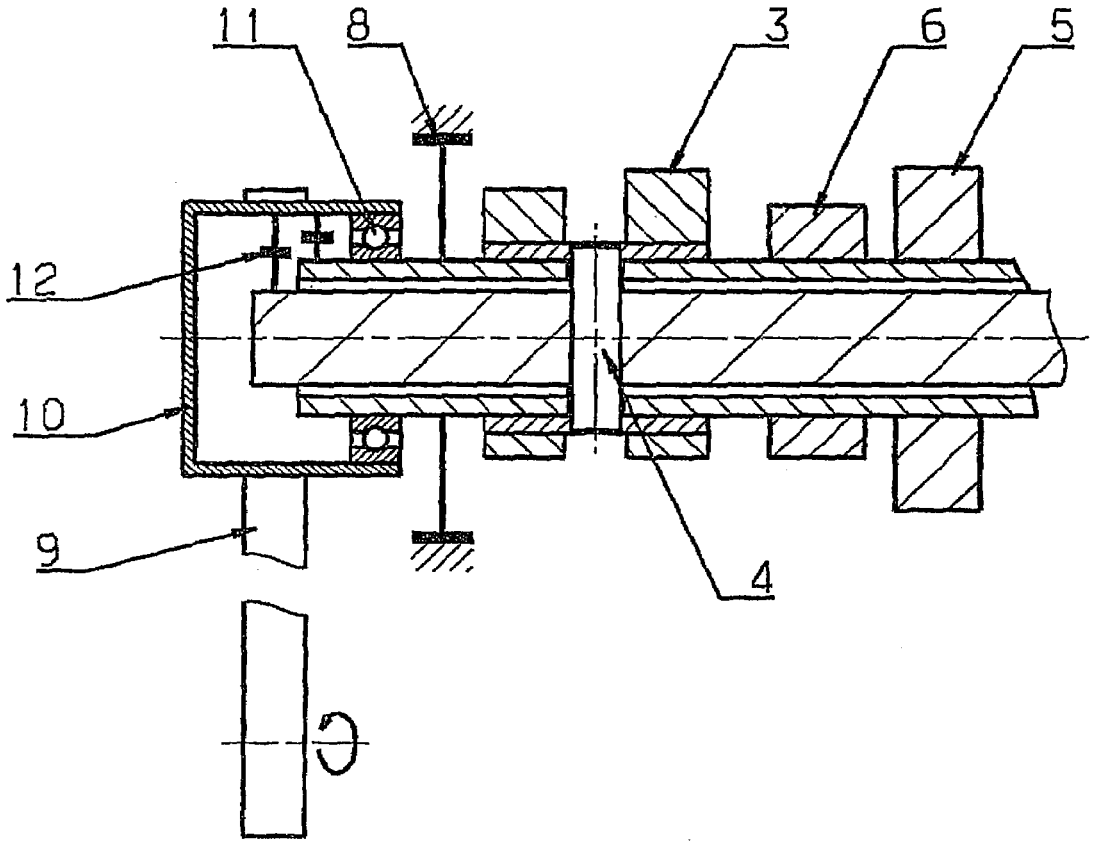

| | | | |
|---|---|---|---|
| DE | 100 63 285 | A1 | 6/2002 |
| DE | 102 09 197 | A1 | 12/2002 |
| EP | 0 643 200 | A1 | 3/1995 |
| EP | 1 362 986 | A1 | 11/2003 |
| JP | 07-286507 | | 10/1995 |

(a)

(b)

CAMSHAFT WITH CAMS THAT CAN BE ROTATED IN RELATION TO EACH OTHER, ESPECIALLY FOR MOTOR VEHICLES

CROSS REFERENCE TO RELATED APPLICATIONS

Applicants claim priority under 35 U.S.C §119 of German Application No. DE 10 2005 005 212.6 filed on Feb. 3, 2005 and German Application NO. DE 10 2005 014 680.5 filed on Mar. 29, 2005. Applicants also claim priority under 35 U.S.C. §365 of PCT/DE2006/000038 filed on Jan. 13, 2006. The international application under PCT article 21(2) was not published in English.

The present invention relates to a camshaft with cams that can be rotated in relation to one another for motor vehicles in particular according to features a through c, especially a through e of the preamble of Patent claim 1.

With such a camshaft, the invention relates to the problem of joining the movements of the camshaft that are movable in relation to one another and mounting them in such as way as to reliably ensure the most friction-free possible movement of the parts with respect to one another in a manner that is reliable in terms of manufacturing and operation.

To this end, the present invention proposes a number of measures, each of which, when taken separately, constitutes a contribution toward solving the inventive problem, whereby a partial or complete combination of all of these features improves the result that can be achieved in each case, namely up to an optimal result with a combination of all the individual measures proposed.

The advantage of the approach according to claim 1 consists of the fact that, in deviation from embodiments known in the past, supporting transverse forces which emanate from the drive of the camshaft and act radially in relation to the camshaft axis do not act on the inside shaft but instead act on the outside shaft, which has a greater resistance on the whole.

Transverse forces emanating radially from a camshaft drive onto the camshaft, which necessarily occur, for example, when the drive of the camshaft is provided by a chain drive or a belt drive, may lead to a radial displacement of the particular shaft that is being driven directly, i.e., the inside shaft or the outside shaft. If the inside shaft of a generic camshaft is being driven, i.e., if the supporting forces of the drive are acting on the inside shaft, then the most friction-free possible rotatability of the inside shaft within the outside shaft can be influenced in a negative sense, which may go as far as resulting in a jamming easily between the inside shaft and the outside shaft. In the case of rotation of the inside shaft within the outside shaft the resulting friction can lead to a reactive deceleration of the relative rotation between the inside shaft and the outside shaft as the friction increases during operation of its camshaft. Therefore, the lowest possible friction is desired between the inside shaft and the outside shaft in rotational movements. Because of its smaller diameter in comparison with the outside shaft, the inside shaft naturally has a lower resistance moment with respect to radial displacement and warping, which is why it is a great advantage if supporting transverse forces emanating from a camshaft drive can act on the outside shaft, which is stiffer with respect to resistance, rather than acting on the inside shaft. In particular, a desired low-friction bearing of the inside shaft within the outside shaft is especially susceptible to radial loads due to the drive.

The measure according to claim 2 has various advantages. A first advantage consists of the fact that a simple and reliable axial fixation between the inside shaft and the outside shaft can be achieved by means of the pinning proposed there between the inside shaft and the outside shaft. It is especially advantageous here that the fixation is attempted only at one end of the camshaft, so that differences in expansion between the inside shaft and the outside shaft during operation of the camshaft cannot have any effect on the axial fixation, which could result in an increase in friction with movement between the two shafts.

Another advantage is that a force transfer element can be connected by the pin, which is itself fixedly connected to the respective shaft, between the camshaft drive and the shaft that is to be connected to this force transfer element. Easily connectable means that the connecting elements can easily be manufactured with the lowest possible tolerances with respect to the connection. In this sense, the embodiments according to Claims 3 through 6 constitute additional advantages, which are explained in greater detail below in conjunction with one embodiment.

The measure according to Claim 7 relates to a camshaft design in which the drive connecting means comprise a space which is under a high lubricant oil pressure during operation of the camshaft and which is directly adjacent to the inside shaft. This results in an axial load on the inside shaft, which in turn means that a frictional force is established due to this axial load when the inside shaft is rotated. To avoid this consequence, the clearance adjacent to the inside shaft is relieved of pressure through the measure according to Claim 7 in the manner described above.

A particularly advantageous embodiment is the subject of Claim 8. Through the mounting of the inside shaft via the cams which are fixedly connected to it and are mounted so they can rotate on the outside shaft, the inside shaft may have a play of practically any extent with respect to the inside circumference of the outside shaft because the bearing is accomplished exclusively via the cams on the outside circumference of the outside shaft.

The inside shaft is practically suspended by the connecting means in the cams connecting the inside shaft to the cams. Due to the resulting radial play between the inside shaft and the outside shaft which may be of any desired size, the axis of the inside shaft can be displaced slightly with respect to the axis of the outside shaft when fastening the cams in the inside shaft, e.g., due to a mutual pin fixation without having to fear any jamming between the inside shaft and outside shaft as a result. Even a minor warping of the inside shaft along this axis, if it were to occur when fastening the cams on the inside shaft, would not be able to result in a function-impairing jamming effect between the two shafts because of the relatively large and adjustable radial play. With the inventive mounting of the inside shaft with a large radial play with respect to the outside shaft, no narrow manufacturing tolerances need be maintained with respect to the inside diameter of the outside shaft and the outside diameter of the inside shaft.

The measure according to Claim 9 pertains to the following problem.

The ring gap between the inside shaft and the outside shaft is fundamentally lubricated with hydraulic oil. The oil under pressure is introduced into the ring gap through radial bores provided through bearing rings on the outside shaft, these bores in turn being aligned with radial bores in the outside shaft. In order for the hydraulic oil not to be able to escape out of the ring gap, so far the axial end areas of the outside shaft in which the ring gap opens are sealed axially on the outside. This results in clearances between the gaskets and the inside shaft which are filled with hydraulic oil. If such a gasket is provided only on one end of the inside shaft at an axial distance from the end face of this inside shaft, the result is a friction-inducing pressure acting on the inside shaft in the axial direction. This problem is easily and reliably eliminated by the measure according to Claim 10.

The embodiment according to Claim 10 represents a simplification that would reduce the manufacturing costs.

The same thing is also true of the embodiment according to Claim 11, according to which a so-called double cam can be manufactured in the same way as a worked camshaft in which cams are joined in a precision manner on a completely machined basic shaft.

The measure according to Claim 12 also constitutes a cost-lowering design simplification.

Through the sealing system according to Claim 9, the inside shaft can be shortened in length in comparison with the outside shaft according to Claim 13. In particular on the end opposite the drive end of the camshaft, the inside shaft can be shortened to the extent that it comes to lie just below the last adjustable cam on this end, which leads to weight savings for the shaft as a whole.

A method of manufacturing a generic camshaft according to Claim 14 is especially advantageous.

This manufacturing method is based on the following consideration.

With the generic camshafts known previously in the state of the art, the inside shaft is mounted within the outside shaft by direct radial support, whereby this may be accomplished by bearings at an distance axially over the length of the camshaft. The cams, which are rotatably mounted on the outside, are usually connected by pins to the inside shaft, with the respective pins passing through a recess in the outside shaft. The recess is of a size in the circumferential direction of the camshaft that indicates the angle of rotation of the respective cam connected to the inside shaft. With such a pin connection, the respective pins are connected to the outside shaft and the inside shaft by a press fit in each case. To achieve a press fit, the pins are usually undercooled when inserted, so that a press fit is achieved when the temperature equalizes. The bores in the cams and the inside shaft often cannot be manufactured without a tolerance in practice, so that pins which are inserted in an undercooled state can be inserted into the inside shaft in particular without applying force. If they are inserted under force, this may result in warping of the inside shaft which would in turn result in jamming of the inside shaft in the outside shaft. If the camshaft is still functional at all, there is an undesirably great friction when the inside shaft is rotated with respect to the outside shaft. Such a high friction is unwanted and is unacceptable because of an increase in response time which is often associated with this but is unacceptable for actual operation in adjustment of the cams with respect to one another during camshaft operation. When manufacturing a generic camshaft according to Claim 14, the problems described above cannot occur at all from the beginning.

This is derived from the following.

Before pinning the inside shaft to the cams rotatably mounted on the outside shaft, the inside shaft is pushed into the outside shaft in a condition in which it is inserted by a thin mounting sleeve made of an incompressible material such as steel. During this condition in which the inside shaft sits within the outside shaft almost without any play in a type of sliding fit, the cams may then be pinned to the inside shaft. To be able to perform this pinning, the pins must be passed through the mounting sleeve. Furthermore, after successful pinning, the mounting sleeve must be completely withdrawable from inside shaft. To this end, the mounting sleeve has axial grooves that are open toward the end of the sleeve. It is possible to pass each of the pins through these axial grooves. To be able to perform the pinning of the entire length of the camshaft, the mounting sleeve is displaced axially until it can be removed entirely from the inside shaft after the last pinning. Due to the use of the mounting sleeve, this ensures that the inside shaft cannot undergo radial warping in the longitudinal direction in the pinning operation. Warping is possible, if at all, only by the amount of play in fitting, in that the inside shaft is supported together with the mounting sleeve in the outside shaft. However, even such extremely minor warping, if possible at all, still would not interfere with friction-free rotatability of the inside shaft within the outside shaft because the inside shaft is not mounted through radial support within the outside shaft but instead it depends practically on the cams to which it is connected and which are rotatably mounted on the outside shaft by way of the pinning elements. In this way, there is a relatively great play determined by the thickness of the mounting sleeve, between the outside shaft and the completely worked inside shaft. This play is so great that even a slight off-centered positioning of the inside shaft which might occur in pinning the outside shaft cannot eliminate this play. Thus even such a minor eccentricity has no harmful effect on friction-free mobility of the inside shaft within the outside shaft.

Figure 2:
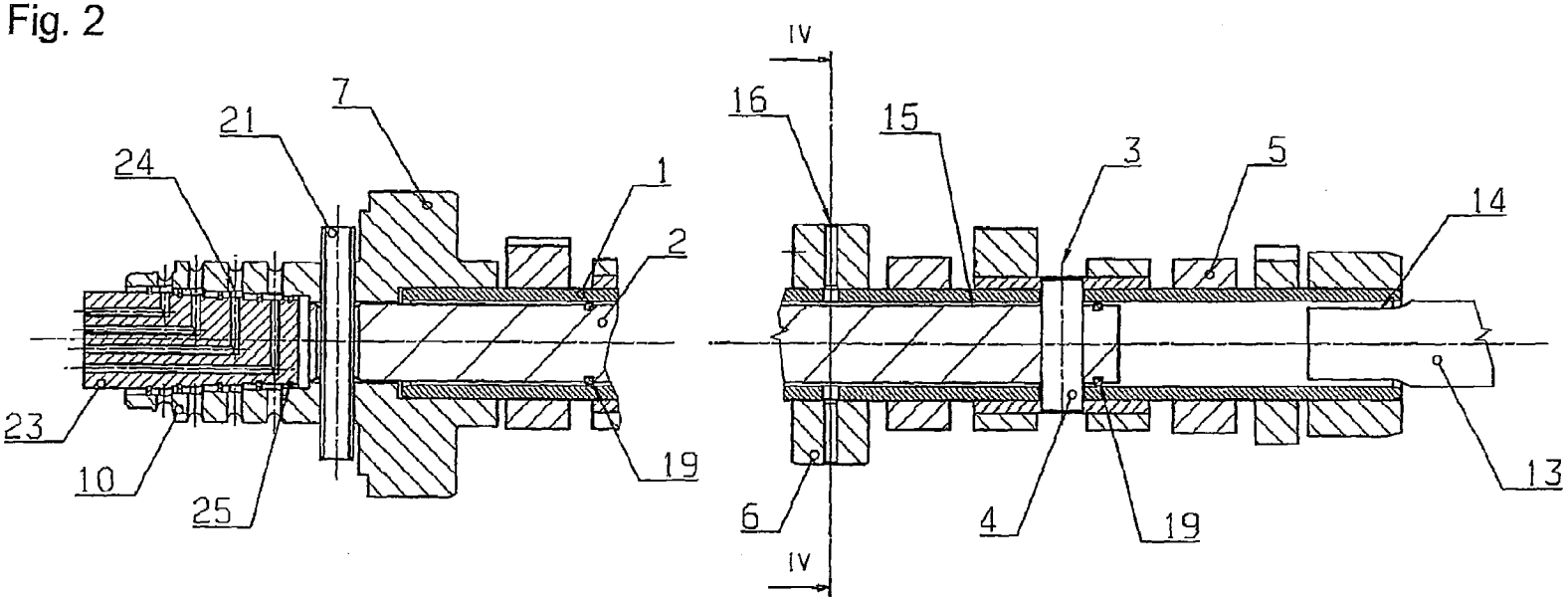
Figure 4:
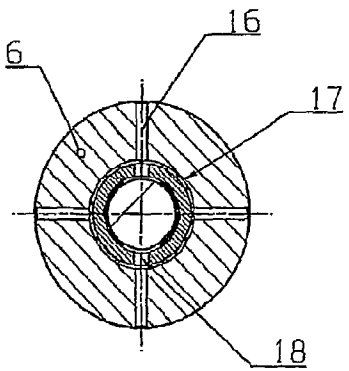
Figure 3:
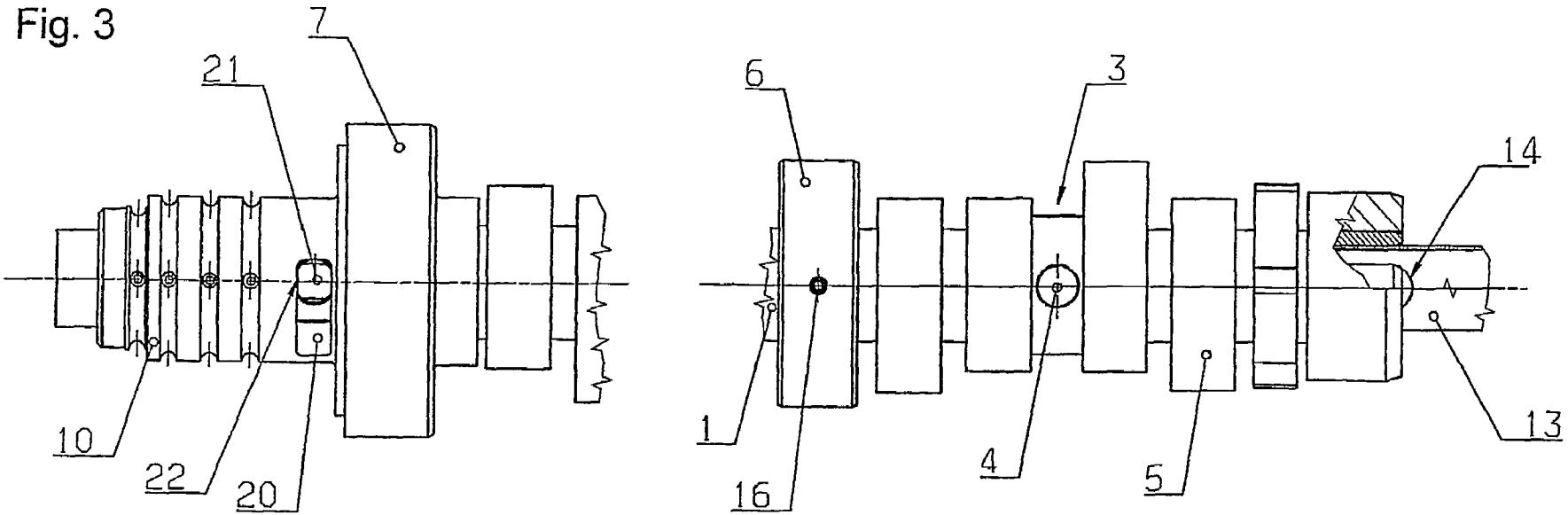
Figure 5:
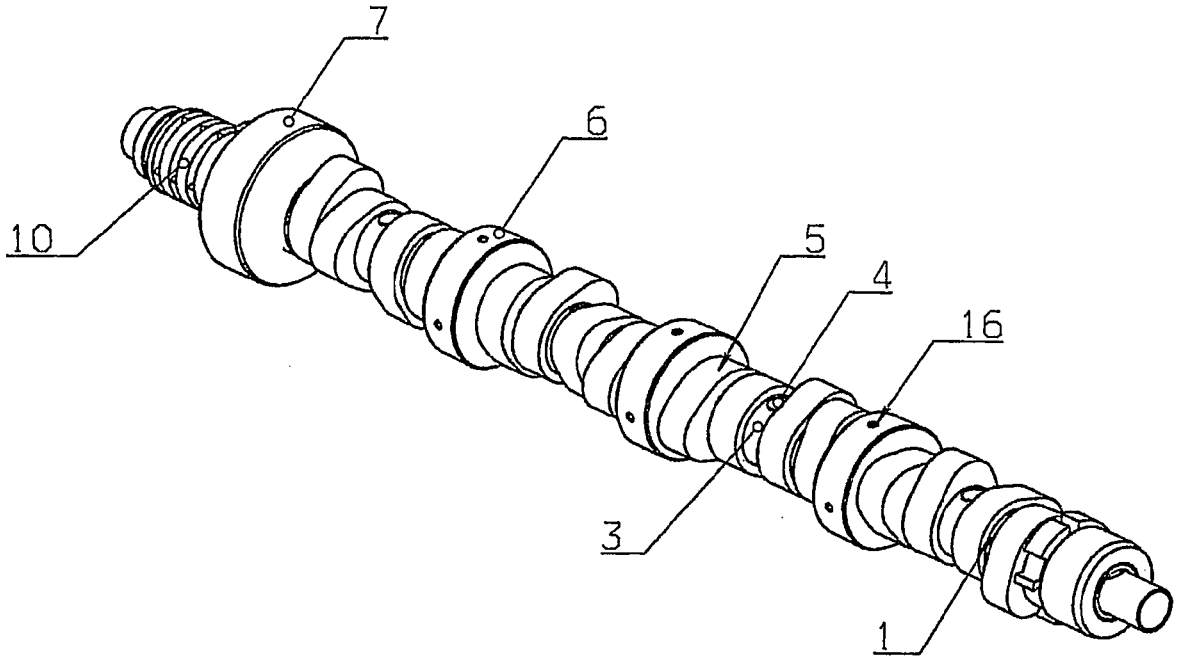
Figure 6:
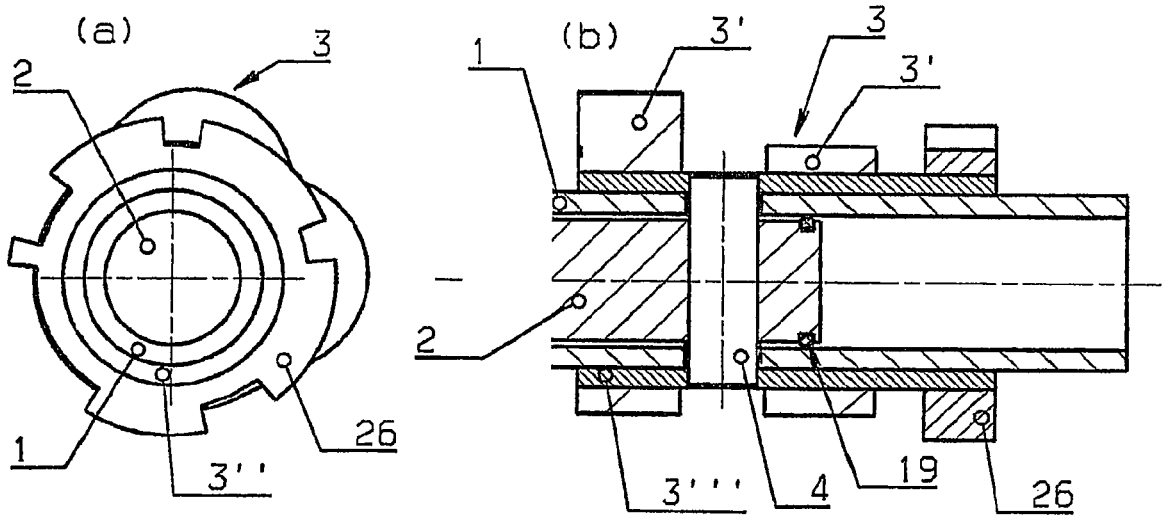
Figure 7:
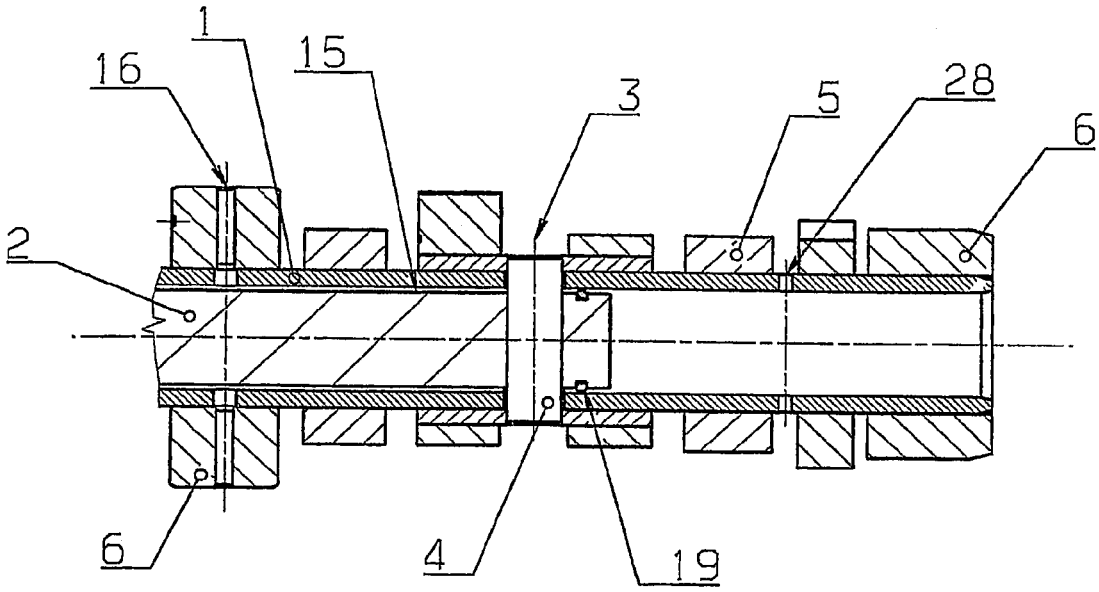
Figure 8:
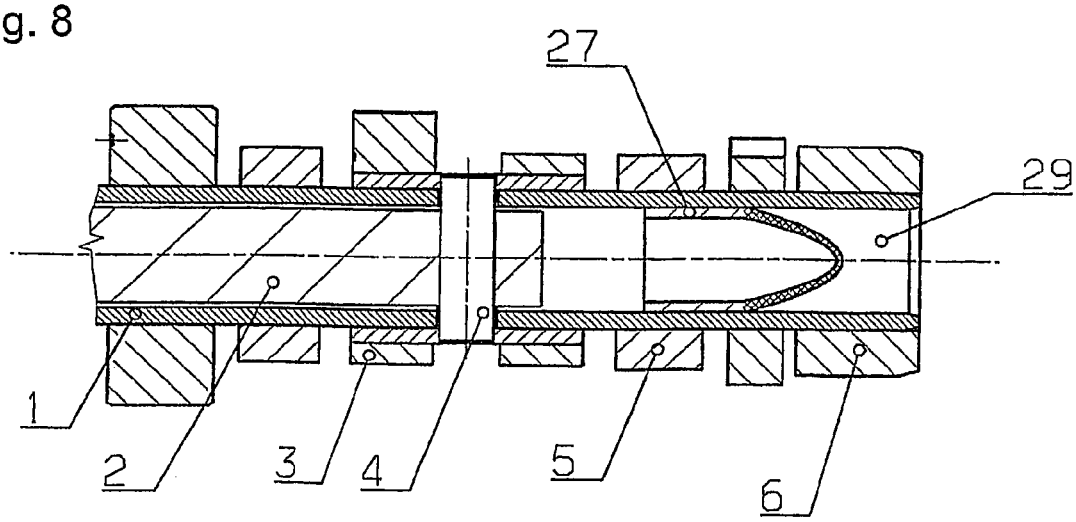
Figure 9:
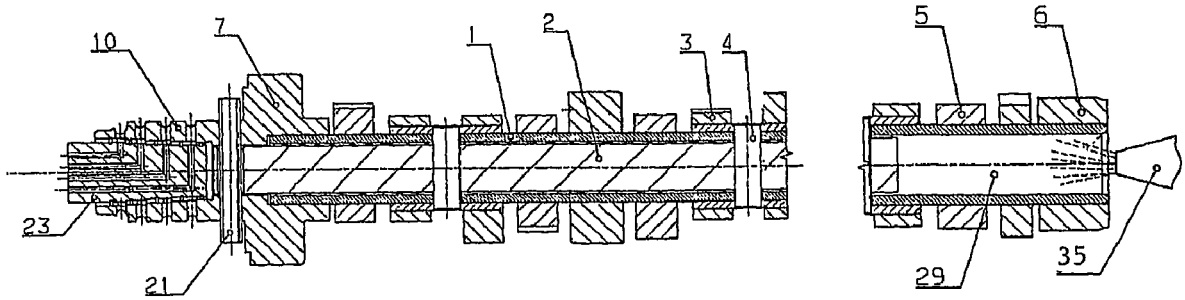
Figure 10:
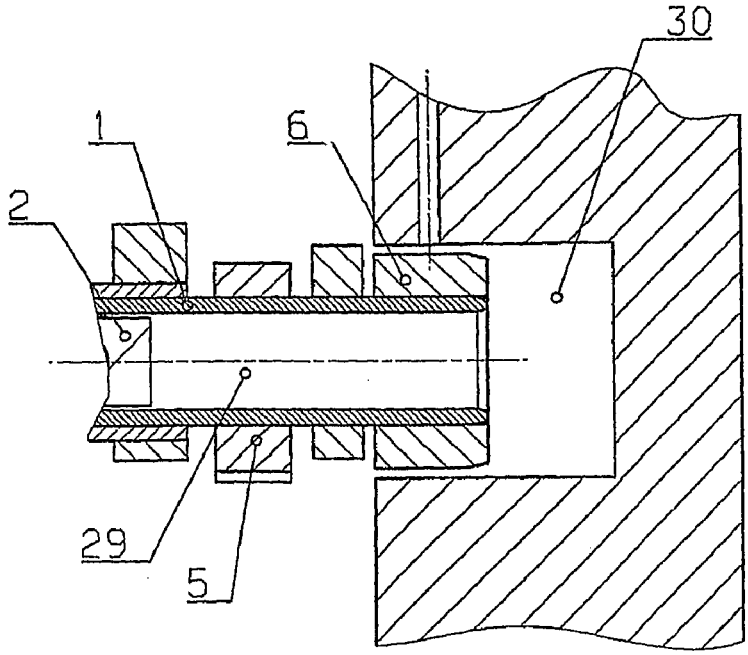
Figure 11:
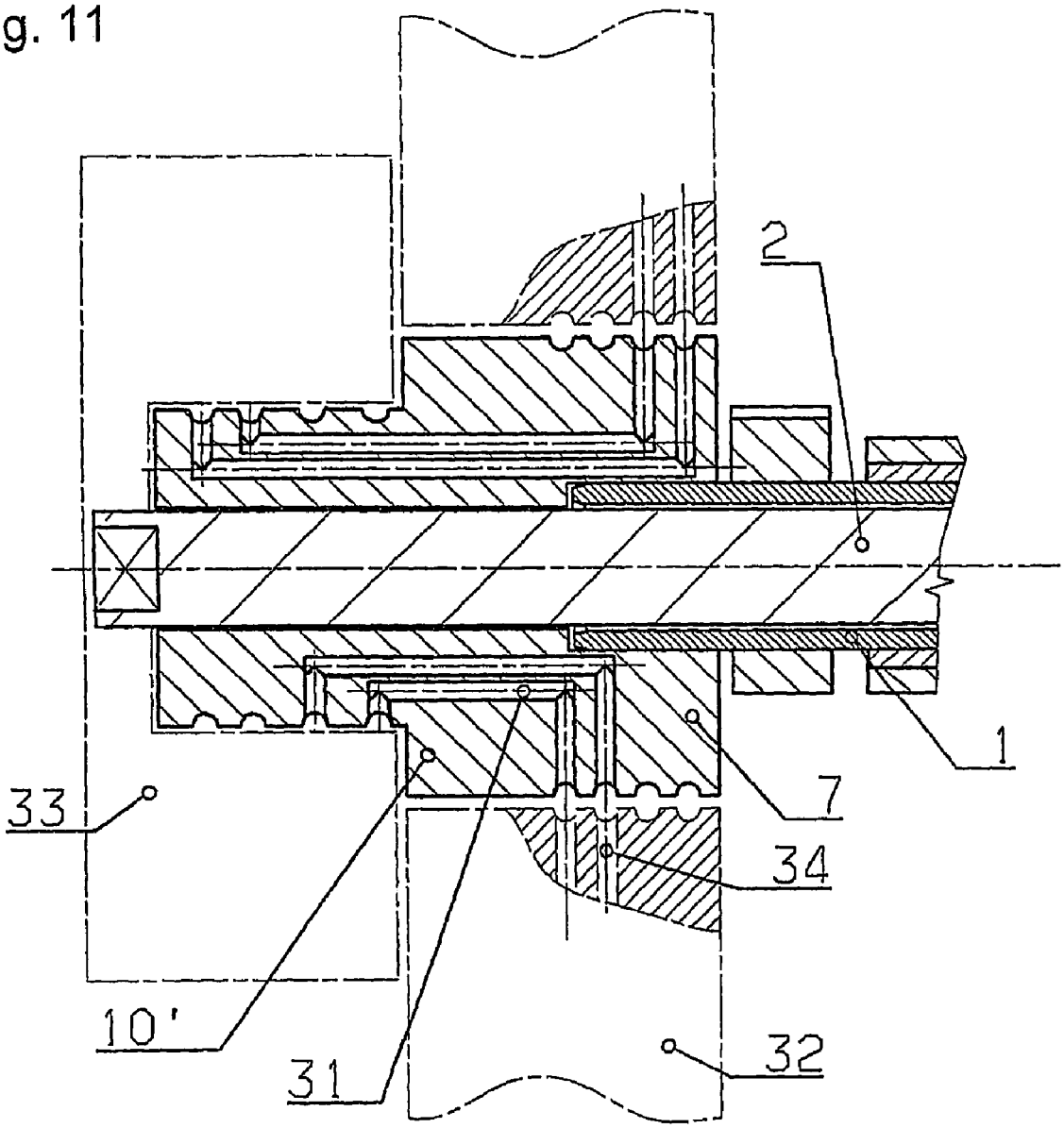

Especially advantageous exemplary embodiments with which all the inventive measures are implemented are explained in greater detail below and are depicted in the drawing, in which FIG. 1 shows a schematic diagram of the connecting means of a camshaft to a rotary drive, FIG. 2 shows a section through a camshaft shown with its length interrupted, FIG. 3 shows a top view of the camshaft according to FIG. 2, FIG. 4 shows a section through the camshaft according to line IV-IV in FIG. 2, FIG. 5 shows a perspective view of a camshaft according to FIGS. 2, 3, FIG. 6*a, b* show a view (a) of a detail of the camshaft and a longitudinal section (b) through this detail, FIG. 7 shows a detail of the right end area of a camshaft according to FIG. 2 in a modified embodiment, FIG. 8 shows a detail of the right end area of a camshaft according to FIG. 2 in another modified embodiment with an axial oil supply channel within the outside shaft and a filter in this supply channel, FIG. 9 shows a camshaft according to FIG. 2 in another modified embodiment with an oil supply channel within the outside shaft and an oil spray device being conveyed axially in this channel, FIG. 10 shows a detail of the right end area of a camshaft according to FIG. 2 in yet another modified embodiment with an axial oil supply channel within the outside shaft and an oil supply space communicating axially with this channel, FIG. 11 shows a detail of the left end area of a camshaft according to FIG. 2 with a modified rotational device, FIGS. 12*a, b* show a detail of a central area of a camshaft according to FIG. 2 with a different axial fixation between the inside shaft and the outside shaft, FIGS. 13*a, b* show a detail of the left end area of a camshaft like that in FIG. 2 with an axially shortened drive connecting means in a longitudinal section (a) and in a view (b) from above, FIGS. 14*a, b* show a detail of the left end area of a camshaft like that in FIG. 2 with an axially shortened drive connecting means in an alternative embodiment to that in FIG. 13 in a longitudinal section (a), in a view from above (b) and in a sectional view (c) according to line XIIVc-XIVc in part (a).

An adjustable camshaft comprises an outside shaft 1 with an inside shaft 2 mounted in it. The inside shaft 2 is pinned to first cams 3 in the form of double cams rotatably mounted on the outside shaft 1. The pinning is provided by pins 4 pressed uniformly into the cams 3 and into the inside shaft 2. To achieve the required press fit, the pins 4 are preferably supercooled when inserted into the corresponding bores in the respective cam 3 and the inside shaft 2. The respective press fits are established with equalization of temperature to an adequate height.

Alternatively, it is also possible to introduce the pins at room temperature.

Between the first cams 3 rotatably mounted on the outside shaft 1 there are second cams 5 fixedly connected to the outside shaft 1 and also bearing rings 6 fixedly connected to the outside shaft 1.

A camshaft having the components described above is shown schematically in FIG. 1 in its end area facing the camshaft drive.

A stationary mounting of the camshaft is indicated by the bearing 8. A belt drive by means of which the camshaft is driven by the crankshaft of a motor vehicle engine is labeled as 9. This belt drive 9 may of course also be a chain drive or a drive of any other type. The belt of the belt drive 9 shown here engages with a drive connecting means 10 of the camshaft. This connecting means 10 is supported with respect to a transverse force acting with respect to the axis of the camshaft via bearing elements 11 on the outside shaft 1. The drive connecting means 10 also have torque transfer means 12 with the help of which the camshaft is driven with regard to the rotational speed on the one hand and with which on the other hand the mutual rotatability between the inside shaft 2 and the outside shaft 1 can be achieved with respect to the connecting means 10. Such devices are known in the state of the art, which is why details of these known drive and adjusting means need not be discussed further here. The schematic diagram in FIG. 1 should demonstrate only how the transverse force load is conducted away from the belt drive 9 to the outside shaft 1 in the case of an adjustable camshaft which is being driven by a belt drive, with a corresponding bearing of the inside shaft 2 that is free of radial forces. The bearing of the inside shaft 2 within the outside shaft 1 is provided exclusively via the pinning of the inside shaft to the first cams 3 by means of pins 4. In other words, this bearing may be considered a type of suspension of the inside shaft 2 on the pins 4 connected to the first cam 3.

The following description refers specifically to FIGS. 2 through 5.

The joining of the outside shaft 1 and the inside shaft 2 will be explained next.

Before insertion into the outside shaft 1, a mounting sleeve 13 with a sliding seating fit is pushed onto the inside shaft 2. Together with the mounting sleeve 13, the inside shaft 2 is then inserted into the outside shaft 1. The mounting sleeve 13 is made of an incompressible material, especially a thin steel plate. The thickness of the wall of the mounting sleeves 13 determines the radial play between the inside shaft 2 and the outside shaft 1. In other words, this means that the radial play between the inside shaft 2 and the outside shaft 1 is to be designed so that the inside shaft 2 together with the mounting sleeve 13 pushed onto it can be inserted into the outside shaft 1.

The pins are placed between the inside shaft 2 and the first cam 3 allocated thereto in a condition in which the mounting sleeve 13 is situated between the inside shaft 2 and the outside shaft 1. To be able to install the pins 4 with which the first cams 3 are fixedly connected to the inside shaft 2, radial recesses in the outside shaft 1 and in the mounting sleeve 13 must be connected. The recesses in the outside shaft 1 are designed as elongated holes extending in the circumferential direction of the outside shaft, the length of these holes limiting the angle of adjustment between the inside shaft 2 and the outside shaft 1. Axial grooves 14 which terminate axially openly out of the mounting sleeve 13 are provided in the mounting sleeve 13 and are diametrically opposed to one another at their ends. The pins 4 can each be inserted through the axial grooves 14. The pins 4 are assembled by non-positive insertion into the boreholes of the first cams 3 and the inside shaft 2. This yields a press fit connection between the first cams 3 and the inside shaft 2. For a simplified assembly, the pins 4 are supercooled for insertion into the respective bores of the first cams 3 and the inside shaft 2. Radial pressing forces may then occur in particular when the bores into which the pins 4 are to be inserted are not accurately aligned due to deviations in the manufacturing tolerance. The inside shaft 1 is practically unable to warp along its axis under the presses forces acting on it radially due to the presence of the mounting sleeve 13 during such a pressing operation because it is prevented from warping by the mounting sleeve 13, which is situated in a form-fitting manner in the ring gap between the inside shaft 2 and the outside shaft 1. Thus, there can be only a displacement of the inside shaft 2 by the minor sliding seat play of the mounting sleeve 13 within the ring gap between the inside shaft 2 and the outside shaft 1. Such a displacement, even if it were to occur, would not be critical, because after removal of the mounting sleeve 13, there remains a radial play that cannot be eliminated by such a displacement. The pin placement of the individual first cams 3 begins at the end of the camshaft and then proceeds over the length of the camshaft with the respective incremental removal of the mounting sleeve 13 out of the outside shaft 1. Such an extraction of the mounting sleeve 13 is necessary in order to be able to insert the pins 4 through the axial grooves 14. After conclusion of the pin placement between all the first cams 3 and the inside shaft 2, the mounting sleeve 13 is separated completely from the camshaft. The condition in which this complete separation takes place is illustrated in FIGS. 2 and 3 at the right end of the camshaft. The mounting sleeve 13 may then be used for assembly of other corresponding camshafts.

The first cams 3 are designed as double cams. Such a double cam is produced like the essentially known worked camshafts by shrinking individual cams 3', 3" onto a basic pipe 3'" with an accurate fit. In the case of the double cams, the pin 4 engages only in the basic pipe 3'" and does so in an area that is situated axially between the two cams 3'" and 3". Instead of a shrink connection, connections by gluing, welding, widening the basic pipe 3'", any form-fitting method or the like are possible as an alternative or in addition.

The modular unit consisting of the individual cams 3', 3" and a basic pipe 3'" to which they are fixedly connected may also include other function elements of the camshaft. FIG. 6 shows a rotary angle generator 26 as a function element having positioning sections on its circumference and being fixedly connected to the basic pipe 3'", for example.

In addition, a spring may be mounted between the inside shaft 2 and the outside shaft 1 so that in the case of an inactive adjusting drive of the camshaft, a predeterminable angle of rotation assignment is automatically established between the inside pipe 2 and the outside pipe 1. To this end, the spring is to be connected to the inside shaft 2 and the outside shaft 1. On the inside shaft 2, this may be accomplished by an abutment, which is attached as an inventive function element to the basic pipe 3''' and may optionally be integrated there into an angle of rotation generator 26. This spring is not shown in the drawing.

The ring gap 15 between the inside shaft 2 and the outside shaft 1 is supplied with lubricating oil under pressure through the bearing rings 6. To this end, four supply bores 16 are provided in the bearing rings 6 according to the diagram in FIG. 4. These supply bores 16 open into a ring channel 17 between the bearing ring 6 and the outside shaft 1. Only two radial bores 18 lead from this ring channel 17 outward in the ring gap 15. In this embodiment, there is a particular feature consisting of the fact that there are fewer radial bores 18 than supply bores 16. This particular feature is made possible by the fact that the supply bores 16 are not supplied with lubricant from a ring-shaped lubricating oil source applied on the outside radially but instead are supplied by sections through alignment with corresponding radially aligned supply channels not shown in the drawing.

From the ring gap 15, the lubricating oil goes through the recesses in the outside shaft 1 through which the pins 4 are passed, to the lubrication points between the outside shaft 1 and first cams 3 rotatably mounted thereon.

To prevent lubricating oil under pressure from being able to escape from the ring gap 15 at the ends of the inside shaft 2, ring gaskets 19 which seal the ring gap 15 are provided there.

The inventive embodiment of the camshaft drive connecting means 10 is discussed in greater detail below, primarily with reference to FIGS. 2 and 3.

One of the two ends of the outside shaft 1 is provided with a connecting flange 7 which is part of the drive connecting means 10. Radial recesses 20 through which a connecting pin 21 passes are provided in the connecting flange 7. The connecting pin 21 passes through a corresponding bore within the inside shaft 2 in a non-positive manner between the diametrically opposed radial recesses 20. The radial recesses 20 have a length in the circumferential direction which determines the angle of adjustment between the inside shaft 2 and the outside shaft 1. The connecting pin 21 represents a first force transfer element. Within the drive connecting means 10 a second force transfer element (not shown) is connected to this first transfer element as a pin 21 in a frictionally engaged and form-fitting manner. The connection is accomplished easily by the fact that the second force transfer element has an axially aligned axial groove assigned to the first force transfer element 21 so that the second force transfer element can be pushed onto the first force transfer element 21 with a precise fit.

Another function of the connecting pin 21 is to secure the inside shaft 2 axially with respect to the outside shaft 1. This yields an extremely simple means of axial fixation of the inside shaft 2 within the outside shaft 1, namely on only one end of the camshaft. In this way, if different expansions occur between the outside shaft 1 and the inside shaft 2, they will have no effect on the axial fixation between the inside shaft 2 and the outside shaft 1.

To have the largest possible force transfer areas on the connecting pin 21 for the axial fixation between the inside shaft 2 and the outside shaft 1 on the one hand and the connection to the second force transfer element on the other hand, the connecting pin is equipped with diametrically opposed planar connecting surfaces in the circumferential direction of the camshaft on the one hand and in the axial direction of the camshaft on the other hand. Of the total of four planar surfaces, this drawing shows only one as an example, labeled as 22. The corner areas between the four planar surfaces are designed to lie on the circumference of a circle. The connecting pin 21 is securely attached to this circular circumference segment with a reliable fit within the inside shaft 2.

A cone 23 in a stationary mount is provided for a supply of oil under pressure within the connecting flange 7 in the drive connecting means device 10. A ring gap 24 between this cone 23 and the connecting flange 7 is maintained for this oil supply under pressure and the connecting flange is in turn sealed by a ring gasket 25 on its end facing the inside shaft 2. In this way, no hydraulic pressure is exerted on the end of the inside shaft 2 and could lead to an increase in friction in rotation of the inside shaft 2 with respect to the outside shaft 1.

In the case of a camshaft according to FIG. 2, lubricating oil may collect in the hollow space of the outside shaft 1 which is not filled up by the inside shaft 2 at the right end in the drawing shown in FIG. 7, said lubricating oil penetrating from a bearing ring 6, which is lubricated with oil at the end of the outside shaft 1, into this space within the outside shaft 1. If this penetrating oil is supplied under pressure and if the space within the outside shaft 1 were to be filled up completely, an axial pressure would build up on the inside shaft 2 adjacent to this space. This would in turn lead to additional friction when there is a relative movement between the inside shaft 2 and the outside shaft 1. To prevent such a pressure from building up due to lubricating oil in the respective space, openings 28 leading radially outward may be arranged in the outer jacket 1 in the respective area.

In the embodiments according to FIGS. 8 through 10, an oil supply to the camshaft from the inside is provided through an axial supply channel 29 in the outside shaft 1 on its end opposite the drive side. This oil supply is an alternative to the oil supply illustrated in the embodiment according to FIGS. 2 through 4, where the oil is supplied through radial openings 18 which are provided in the outside shaft 1 and are supplied with lubricating oil under pressure through radial bores 16 in a bearing ring 6.

If the oil supply to the inside of the camshaft is accomplished through an oil supply channel 29 as described above, this supply channel 29 must be able to communicate with the ring gap 15 between the inside shaft 2 and the outside shaft 1 without any gaskets. With respect to the embodiment according to FIG. 2, this means that the radial sealing ring 19 provided there must not be present here.

The same thing is also true of the radial sealing ring on the opposite end of the camshaft. Without such gaskets 19, lubricating oil introduced into the supply channel 29 under pressure can flow through the ring gap 15 between the inside shaft 2 and the outside shaft 1 as far as the drive end of the camshaft, where this lubricating oil can flow outward through the radial recess 20 provided in the embodiment of the camshaft according to FIG. 2.

In the embodiment according to FIG. 10, the axial supply channel 29 is supplied from the bearing ring 6 provided at this end of the camshaft, whereby a transitional space 30 which is acted upon by the lubrication of the bearing ring 6 is provided around the respective end of the camshaft, with lubricating oil supplied under pressure from this transitional space out of the bearing ring 6 can flow into the interior of the outside shaft 1.

Alternatively, lubricating oil can also be introduced into the supply channel 29 through an oil spray nozzle 2 that delivers oil axially into the supply channel 29 according to the embodiment illustrated in FIG. 9. An oil spray nozzle may be used here, for example, as an oil supply device 32, such as that used in a generally known manner for spray cooling of a lift piston of an internal combustion engine.

An embodiment of a camshaft shown in FIG. 8 with a supply channel 29 is especially expedient, whereby a filter 27 is inserted into the supply channel 29. This filter 27 may be designed as a disk-shaped particulate screen. This particulate screen may be designed in the form of a bell and/or a funnel, each with an upstream end that is closed. Such a bell-shaped design has the advantage that dirt particles deposited from the lubricating oil can be separated radially by the screen due to the centrifugal force generated by the rotating camshaft and can accumulate on the inside of the pipe. The central filter area thus remains essentially free of dirt deposits even in lengthy operating times of the camshaft.

Figure 12:
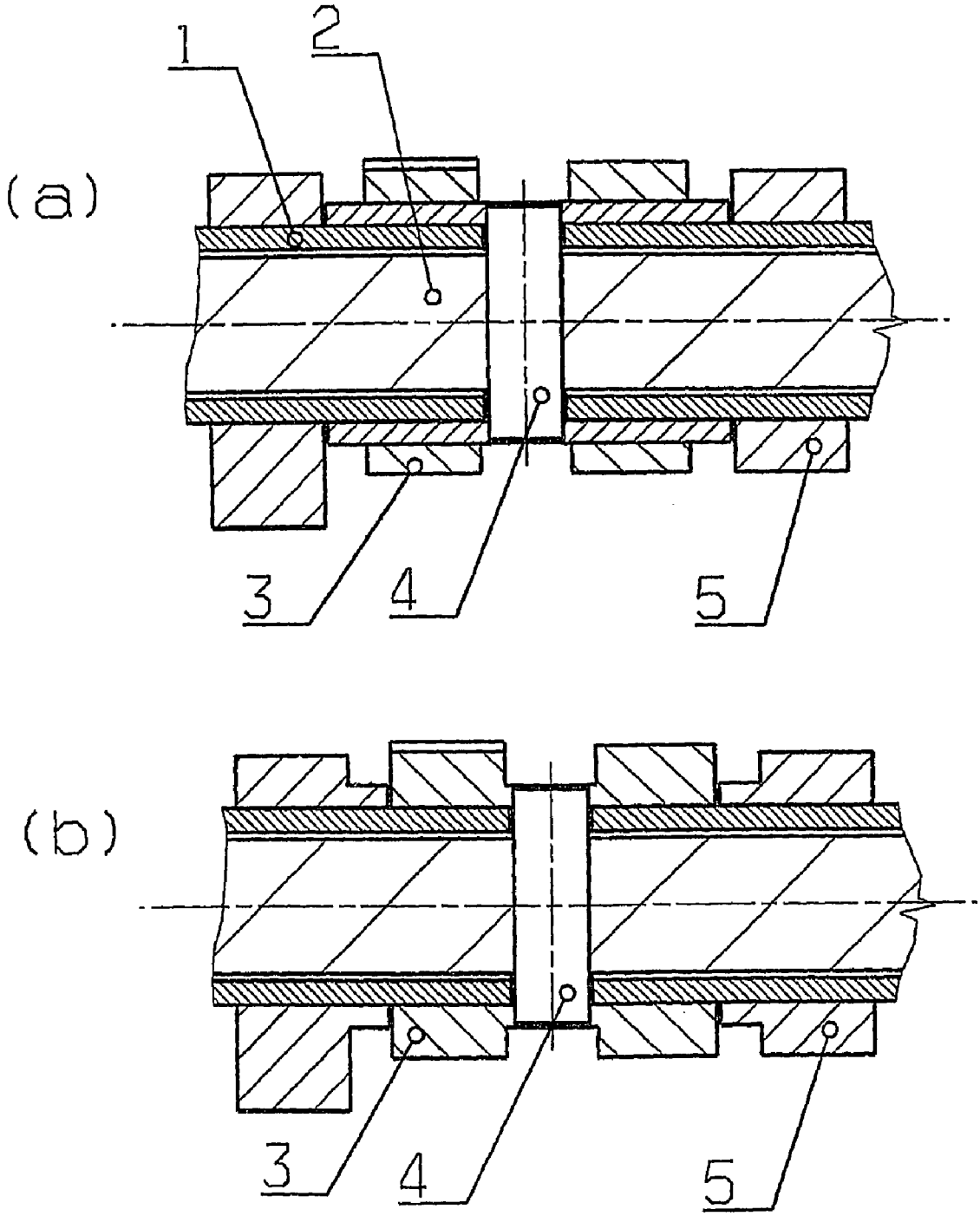

In the embodiment according to FIG. 2, there is axial fixation between the inside shaft 2 and the outside shaft 1 via a radial connecting pin 21 which passes through both shafts 1, 2. An alternative to such axial fixation between the inside shaft 2 and the outside shaft 1 is shown in FIG. 12, namely in two different variants according to parts a and b of this figure.

This alternative fixation consists of the fact that the first adjustable camshaft 3 connected to the inside shaft 2 is mounted with an accurate axial fit between two neighboring cams fixedly attached to the outside shaft 1. To be able to obtain such an accurate fit, the axial widths of the respective first cam 3 and/or the neighboring second cam 5 must be designed accordingly. This means that the respective cams 3, 5 are to be equipped with axial extensions that act as stops in such a way that an axial fit, i.e., accurate fixation between the inside shaft and outside shaft is provided.

In the embodiment according to FIG. 12*a*, there is an worked first double cam 3 whose axial width is designed so that an axial fit can be achieved between two neighboring second cams 5 fixedly connected to the outside shaft 1. In assembly of the second cams 5 on the outside shaft 2, it is important to be sure that the least possible rotational play, which is as small as possible but still adequate, is ensured between the first and second cams 3; 5.

In the embodiment according to FIG. 12*b*, the second cams 5 are provided with stops which extend the axial width and are capable of securing the first cams 3 with an accurate axial fit between two neighboring second cams 5 designed accordingly.

FIG. 11 shows a different type of oil supply for a hydraulic oil drive connected there in the drive connecting means 10 according to the embodiment in FIG. 2. The respective drive connecting means 10 is labeled as 10' in FIG. 11. This drive connecting means 10' is provided with oil carrying channels 31. These oil carrying channels 31 each lead radially outward at one end into an oil supply device 32 and at the other end to a hydraulic drive 33. The components 32 and 33 are indicated only with dash-dot lines in the drawing. In the example shown here, a bearing device of the camshaft serves as the oil supply device 32, the drive connecting means 10 being designed as an inner bearing ring fixedly connected to the outside shaft 1, while the oil supply is provided through supply channels 34 within a stationary outer bearing ring carrying the inner bearing ring. Such an oil supply of a hydraulically operated camshaft adjusting mechanism is extremely advantageous because it can be implemented with just a few components. In particular, such an oil supply mechanism is short axially at the drive end so that axial space can be saved.

With the parts of the inventive camshaft that move in relation to one another, it is possible to entirely or at least largely eliminate oil lubrication if the contrarotating partner is provided with a wear-resistant coating on the one hand and with a hardened surface on the other hand. The outside shaft and the double cam may be provided with a hardened surface in particular.

Whereas the adjusting drive for the adjustable camshaft described as a hydraulic drive in the exemplary embodiments illustrated and described here, mechanical or electric drives may of course also be used. This does not affect the other inventive details of the camshaft.

Figure 13:
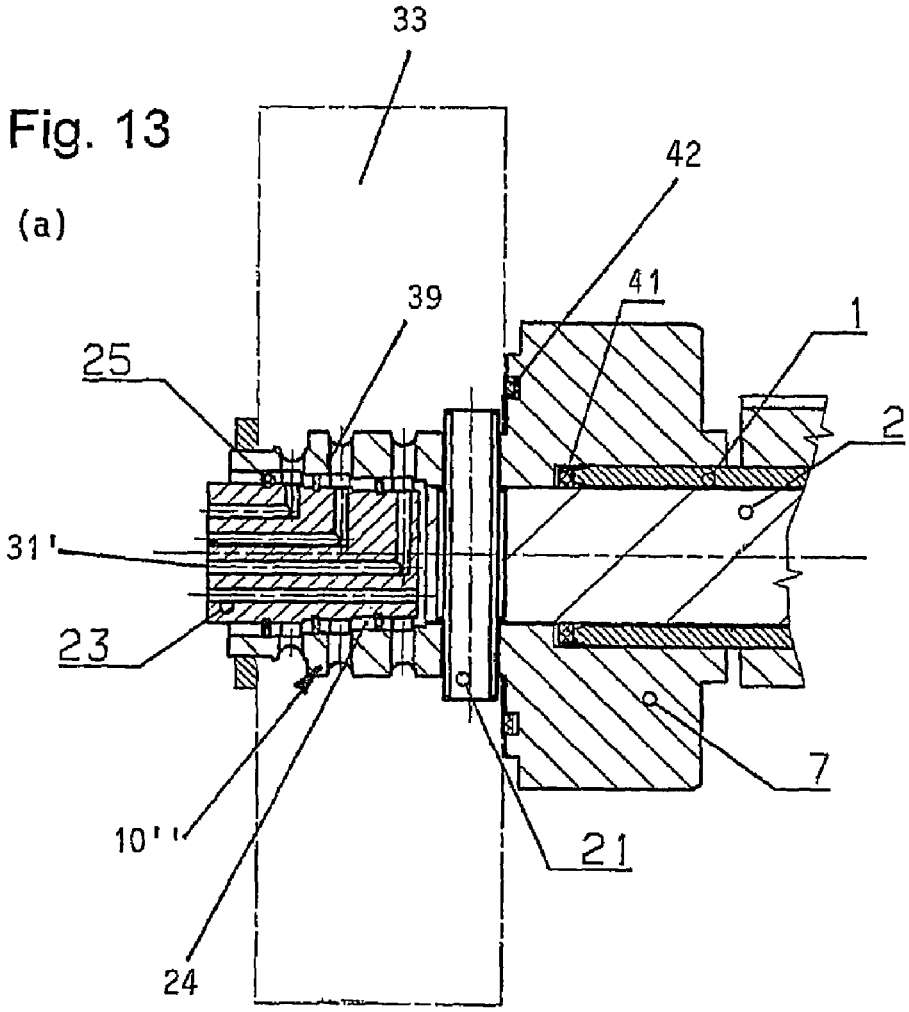
Figure 13:
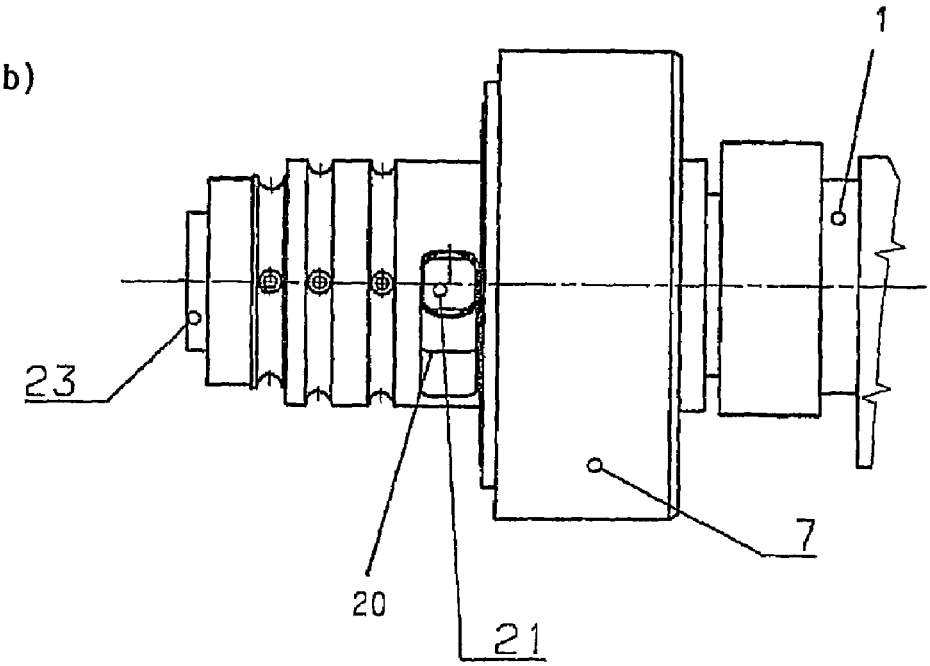

With the drive connecting means 10" according to FIG. 13, as in the embodiment according to FIG. 11, the shortest possible axial length is desired. The drive connecting means 10" are mounted on a stationary cone 23. Oil carrying channels 31' supplied with oil from the left end face of the cone lead through this cone 23. These oil carrying channels 31' are designed to run at a right angle inside the cone 23, so they open radially out of the cone 23 into a ring gap 24 between the cone 23 and the drive connecting means 10. This ring gap 24 is subdivided by ring gaskets 25 into sections spaced an axial distance apart. These axial sections are connected to radial bores 39 in the drive connecting means 10", leading radially outward into a hydraulic drive 33. The number of these radial bores 39 is given as a total of four for a certain hydraulic drive 33. In the embodiment according to FIG. 13, the function of one of these four radial bores is integrated into an area of the drive connecting means 10" which essentially serves different purposes. This is the area of the drive connecting means 10" in which the connecting pin 21 is situated, by means of whose operation the inside shaft 2 and the outside shaft 1 can be rotated with respect to one another. The connecting pin 21 passes through a radial opening 20 in the drive connecting means 10". This opening 20 is not filled by the connecting pin 21 in the circumferential direction because this recess 20 must allow rotational adjustment of the connecting pin 21 in this direction. In order for the recess 20 to be able to fulfill the same function as the radial bores 39, additional gaskets in the form of ring gaskets 41 and 42, for example, are necessary. The ring gasket 41 seals the space of the recess 20 with respect to the ring gap between the outside shaft 1 and the inside shaft 2. The ring gasket 42 ensures a seal in the hydraulic drive 33 with respect to the outside.

Figure 14:
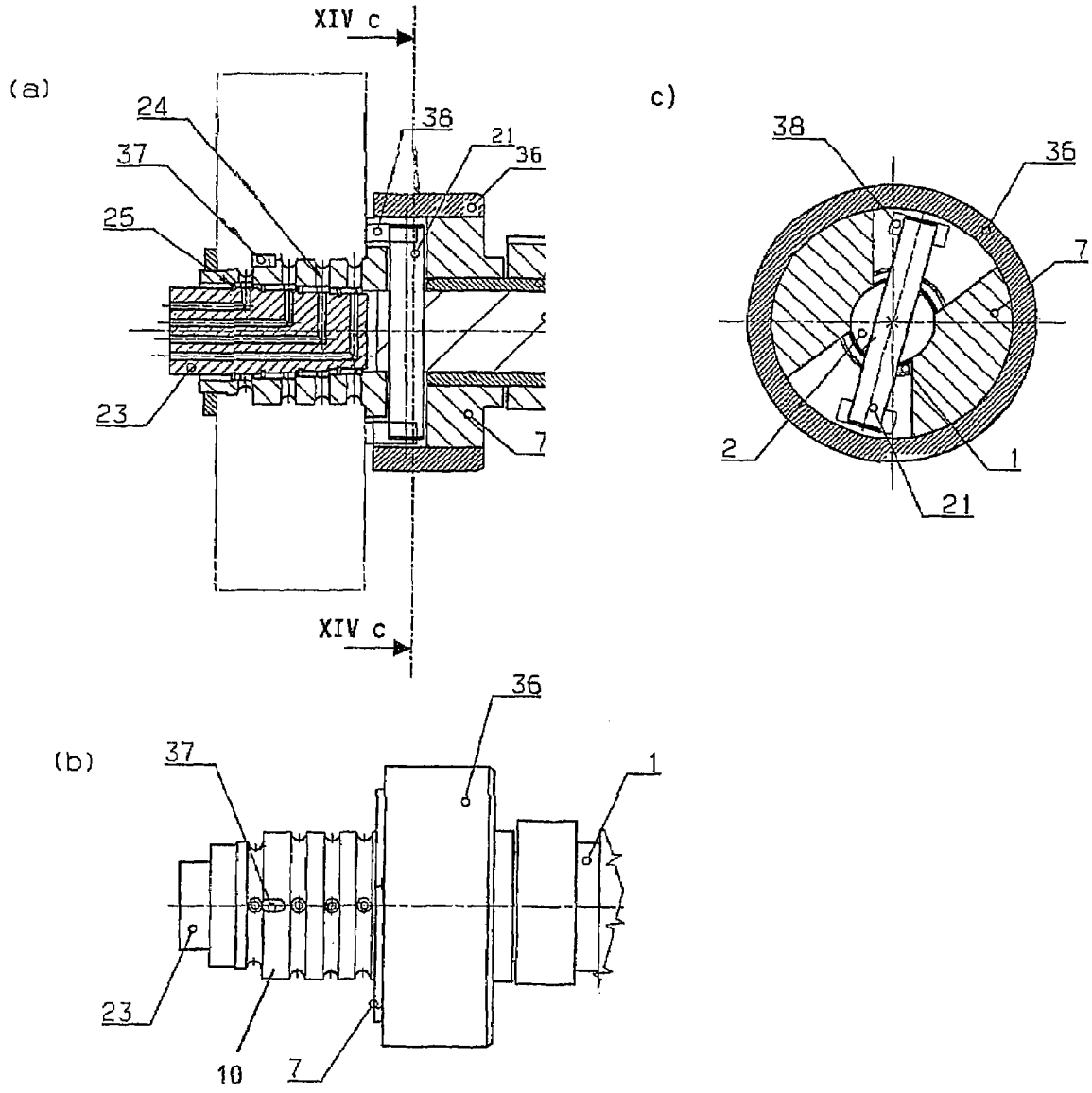

FIG. 14 shows another alternative embodiment of the drive connecting means 10 in a basic design of this drive connecting means according to the embodiment in FIG. 2. In the embodiment according to FIG. 14, the axial shortening with respect to the camshaft is achieved by a displacement of the connecting pin 21 into the axial interior of the neighboring bearing ring, whereby this bearing ring is an integrated component of the connecting flange 7.

To be able to mount the connecting pin 21 with such an accommodation of the connecting pin 21 within the connecting flange 7 forming the bearing ring on the drive end, among others, the connecting flange 7 must consist of a central core area and a bearing ring 36 placed thereon and forming the bearing.

FIG. 14 shows a force transfer element by means of which the torque required to turn the connecting pin 21 is transferred from the hydraulic drive 33 in the form of a connecting fork 38.

To be able to ensure an antitwist connection between the drive connecting means 10 and the respective force transfer element of the hydraulic drive 33, this connection is accomplished by a form-fitting connection in the direction of rotation, namely by an antitwist protection means 37 in the form of a tongue-and-groove locking means, for example.

All the features depicted in the description and in the following claims may be essential to the invention either individually or when combined together in any form.

The invention claimed is:

1. A camshaft having contrarotating cams for motor vehicles, comprising:

a) an inside shaft and an outside shaft, the shafts being arranged so that they are contrarotating one inside the other, b) a first cam rotatably mounted on the outside shaft and fixedly connected to the inside shaft through at least one radial opening in the outside shaft;

c) a second cam fixedly connected to the outside shaft;

d) connecting means for connecting a camshaft rotary drive provided on one axial end of the camshaft, wherein the connecting means allow a contrarotation of the first and second cams that is limited in a circumferential direction;

e) a rotary drive exerting radial supporting forces acting on the camshaft; and (f) a connection between the connecting means and the outside shaft for transferring transverse supporting forces acting radially on the camshaft exclusively to the outside shaft from the camshaft rotary drive;

wherein the connecting means comprises a connecting pin as a first force transfer element between the rotary drive and the inside shaft or the outside shaft, said connecting pin passing through a recess provided in one of the shafts and being secured in the other respective shaft, wherein the recess allows a rotation of the connecting pin that is limited in a circumferential direction of the camshaft and holds the shaft through which the connecting pin passes, while the connecting pin is supported in an axial direction of the camshaft with a lowest possible play in the recess.

2. The camshaft according to claim 1, further comprising a second force transfer element of the connecting means, said second force transfer element being provided with a recess that is adapted in a complementary manner to the connecting pin in a circumferential direction of the camshaft, wherein the second force transfer element can be pushed onto the connecting pin via the recess in the second force transfer element, in the axial direction of the camshaft in a non-positive manner with an accurate fit exclusively in the circumferential direction of the camshaft.

3. The camshaft according to claim 2, wherein the connecting pin is provided with diametrically parallel opposite planar contact surfaces for contact with a corresponding opposing surface of the recess in one of the two shafts and with an opposing corresponding surface of the second force transfer element that is to be pushed onto the connecting pin.

4. The camshaft according to claim 3, wherein corner areas are situated between the planar contact surfaces of the connecting pin, said corner areas forming a smaller circular circumference than a circumference of the connecting pin itself, and wherein an axis of the connecting pin serves as a midpoint of said smaller circumference.

5. The camshaft according to claim 2, wherein the second force transfer element is operated hydraulically by camshaft lubricating oil, wherein oil carrying channels are provided for the oil supply to the connecting means in an end of a bearing ring fixedly connected to the outside shaft at an end of the camshaft facing the drive, said oil supply channels communicating at one end with a lubricating oil supply device of the bearing ring and at another end with a hydraulic drive of the second force transfer means.

6. The camshaft according to claim 2, wherein:

a connecting flange is fixedly connected to a drive end of the outside shaft, the connecting pin passes through the inside shaft in its circumferential direction with a form-fitting connection and passes through the outside shaft in an area of the connecting flange with some play, the connecting flange extends beyond the connecting pin in an axial direction of the camshaft so that the flange functions as a distributor for lubricating oil, the lubricating oil acts as hydraulic fluid and is introduced into a hydraulic drive, the drive producing adjustment of the inside shaft and the outside shaft, radial bores running radially to a camshaft axis carry lubricating oil outward an outside of the connecting flange, and a radial recess is provided in the outside shaft so that an adjusting play of the connecting pin is provided in the outside shaft, said recess functioning as one of the radial bores.

7. The camshaft according to claim 1, wherein the connecting pin is fixedly connected to the inside shaft.

8. The camshaft according to claim 1, further comprising a ring gasket that seals a ring gap that is filled with lubricant oil under pressure between the inside shaft and the outside shaft toward an outside on at least one axial end.

9. The camshaft according to claim 1, wherein the outside shaft is connected to bearing rings, and lubricating oil is introduced through supply bores in the bearing rings, said supply bores leading into a ring gap formed between the inside shaft and the outside shaft, wherein the supply bores open into a ring groove which is provided between the outside shaft and the bearing ring, and wherein there are fewer radial bores leading from the outside shaft than there are supply bores from the respective bearing ring.

10. The camshaft according to claim 1, wherein each individual cam is designed as a double cam in which two individual cams that are adjacent to one another but at a distance axially are joined together to form a fixedly interconnected unit, and wherein each double cam is placed on a basic pipe and is fixedly connected thereto.

11. The camshaft according to claim 10, wherein additional parts of the camshaft are also placed on the basic pipe.

12. The camshaft according to claim 1, wherein the connecting means cooperate with a connecting flange which is fixedly joined to the outside shaft, and wherein a bearing ring of the camshaft is integrated into the outside shaft.

13. The camshaft according to claim 1, wherein the inside shaft is shorter than the outside shaft.

14. The camshaft according to claim 13, wherein there is at least one opening in an area of the outside in an area of the outside shaft that does not overlap the inside shaft, shaft that does not overlap the inside shaft, said opening leading radially outward for removing lubricating oil.

15. The camshaft according to claim 14, wherein the outside shaft is provided with an oil-lubricated bearing ring on its end forming the axial supply channel, and wherein a lubrication space of said oil-lubricated bearing ring communicates with the axial supply channel through a transitional space which is sealed with respect to the outside.

16. The camshaft according to claim 13, wherein the connecting means acting on the outside shaft has a form-fitting connection to the outside shaft or the connecting flange fixedly connected thereto.

17. The camshaft according to claim 1, wherein a spring is provided between the inside shaft and the outside shaft, said spring establishing a predetermined rotational angle allocation between the inside shaft and the outside shaft when the rotary drive of the camshaft is inactive.

18. The camshaft according to claim 1, wherein an end of the outside shaft on a side facing away from the drive connecting means is designed as an axial supply channel for lubricating oil to be supplied for oil lubrication in an interior of the outside shaft in a ring gap between the inside shaft and the outside shaft, and wherein the ring gap communicates at one end with the axial supply channel without any gaskets and opens at another end into a space leading to the outside.

19. The camshaft according to claim 18, further comprising an oil supply device for supplying lubricating oil to the axial supply channel.

20. The camshaft according to claim 19, wherein the oil supply device is designed as an oil spray nozzle.

21. The camshaft according to claim 1, further comprising a mechanical filter disposed in the axial supply channel, through which filter the lubricating oil flows.

22. The camshaft according to claim 21, wherein the filter is designed in the form of a disk with a bell shape or a funnel shape, with a closed end of the filter facing upstream of the oil supply.

23. The camshaft according to claim 21, wherein the filter is designed as a particulate screen filter.

24. The camshaft according to claim 1, wherein the first cam is guided with little axial play between two second cams, and wherein the inside shaft and the outside shaft are mounted axially with respect to one another exclusively via axial guidance between the first and second cams.

25. The camshaft according to claim 1, wherein movable elements of the camshaft are coated in a wear-resistant coating and at least the outside shaft is hardened at least on its outside circumference.

26. The camshaft according to claim 1, wherein the connecting pin passes through the inside shaft in a form-fitting manner in its circumferential direction and passes through the outside shaft in the area of a connecting flange connected thereto so the connecting pin passes through the shafts with some adjustment play, and wherein the connecting pin is situated axially inside a bearing ring which forms a drive end of the outside shaft.

27. The camshaft according to claim 26, wherein the bearing ring is assembled from two concentric components situated one inside the other, one component being a bearing ring core sitting directly on the outside shaft and have a recess for rotational adjustment of the connecting pin, and the other component being an outer closed bearing ring that is placed axially on the core.

28. A method for manufacturing a camshaft having an inside shaft, and an outside shaft, a first cam rotatably mounted on the outside shaft and fixedly connected to the inside shaft through at least one radial opening in the outside shaft; and a second cam fixedly connected to the outside shaft, the method comprising the following steps:

inserting the inside shaft into the outside shaft in a state in which the inside shaft is sheathed by a mounting sleeve; the mounting sleeve having recesses in the form of axial grooves running axially outward, said grooves being open an axial end of the sleeve; and inserting pins into the inside shaft for fastening the cams to the inside shaft, wherein the pins are inserted through areas inside the axial grooves of the mounting sleeve, wherein the mounting sleeve is displaced axially in order to insert all of the pins, and after insertion of all the pins, the pins are removed entirely from the outside shaft.

* * * * *